US012656056B2

(12) United States Patent
Vandroux et al.

(10) Patent No.: US 12,656,056 B2
(45) Date of Patent: Jun. 16, 2026

(54) INSTALLATION AND PROCESS FOR PRODUCTION OF A CRYOGENIC FLUID

(71) Applicant: L'Air Liquide, Societe Anonyme pour l'Etude et l'Exploitation des Procedes Georges Claude, Paris (FR)

(72) Inventors: Emeline Vandroux, Champigny-sur-Ma (FR); Florian Martin, Sassenage (FR); Ludovic Granados, Champigny-sur-Ma (FR); Jean-Marc Bernhardt, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 260 days.

(21) Appl. No.: 18/373,052

(22) Filed: Sep. 26, 2023

(65) Prior Publication Data

US 2024/0102728 A1 Mar. 28, 2024

(30) Foreign Application Priority Data

Sep. 26, 2022 (FR) ..... FR 2209712

(51) Int. Cl.
*F25J 1/00* (2006.01)
*F25J 1/02* (2006.01)

(52) U.S. Cl.
CPC ..... *F25J 1/001* (2013.01); *F25J 1/0047* (2013.01); *F25J 1/0072* (2013.01); *F25J 1/0279* (2013.01)

(58) Field of Classification Search
CPC ..... F25J 1/001; F25J 1/0067; F25J 1/0065; F25J 1/0062; F25J 1/0072; F25J 1/0205; F25J 2250/02
See application file for complete search history.

(56) References Cited

U.S. PATENT DOCUMENTS 4,530,744 A * 7/1985 Smith ..... F25J 1/0062 204/266
5,579,655 A * 12/1996 Grenier ..... F25J 1/005 62/913

(Continued)

FOREIGN PATENT DOCUMENTS

JP 2004 210597 7/2004

OTHER PUBLICATIONS

Kuendig, Andres et al., Large Scale Hydrogen Liquefaction in combination with LNG re-gasification, 2006, 16th World Hydrogen Energy Conference 2006, vol. 23, Jun. 1, 2006, pp. 3326-3333 (Year: 2006).*

(Continued)

*Primary Examiner* — Keith M Raymond
(74) *Attorney, Agent, or Firm* — Justin K. Murray

(57) ABSTRACT

The invention relates to an installation and a process for production of a cryogenic fluid, in particular of liquefied hydrogen, comprising, positioned in at least one cold box, a set of heat exchangers in thermal exchange with the circuit for hydrogen to be cooled, the installation comprising a device for pre-cooling, which is configured to pre-cool the circuit for gas to be cooled to a first determined temperature, and a device for cryogenic cooling which is configured to cool the circuit for gas to be cooled to a second determined temperature, lower than the first temperature, the cycle gas cooling unit and/or the cycle gas heating unit comprise(s) one or more first cycle heat exchangers distinct from the first part of the pre-cooling heat exchangers of the circuit for the gas to be cooled, these first cycle heat exchangers also being cooled by thermal exchange with the pre-cooling fluid circuit of the pre-cooling device.

12 Claims, 2 Drawing Sheets

(56) References Cited

U.S. PATENT DOCUMENTS

| | | | | |
|---|---|---|---|---|
| 11,391,511 | B1 * | 7/2022 | Thomas | F25J 1/0288 |
| 2007/0227185 | A1 * | 10/2007 | Stone | F25J 1/0042 62/611 |
| 2018/0347897 | A1 * | 12/2018 | Cardella | F25J 1/0067 |

OTHER PUBLICATIONS

French Search Report for FR 2 209 712, mailed Apr. 13, 2023.
Kuendig, et al., "Large Scale Hydrogen Liquefaction in Combination with LNG Re-Gasification," 16th World Hydrogen Energy Conference 2006, vol. 23, Jun. 1, 2006, pp. 3326-3333.
Hagenbach, et al., "Commercial Production of Liquid Neon," Proceedings of the Cryogenic Engineering Conference, vol. 9, Jan. 1, 1963, pp. 557-560.
Krasae-In, Songwut, "Efficient Hydrogen Liquefaction Processes, " ISBN978-82-471-1869-6.r, pp. 43-44.

* cited by examiner

[FIG.1]
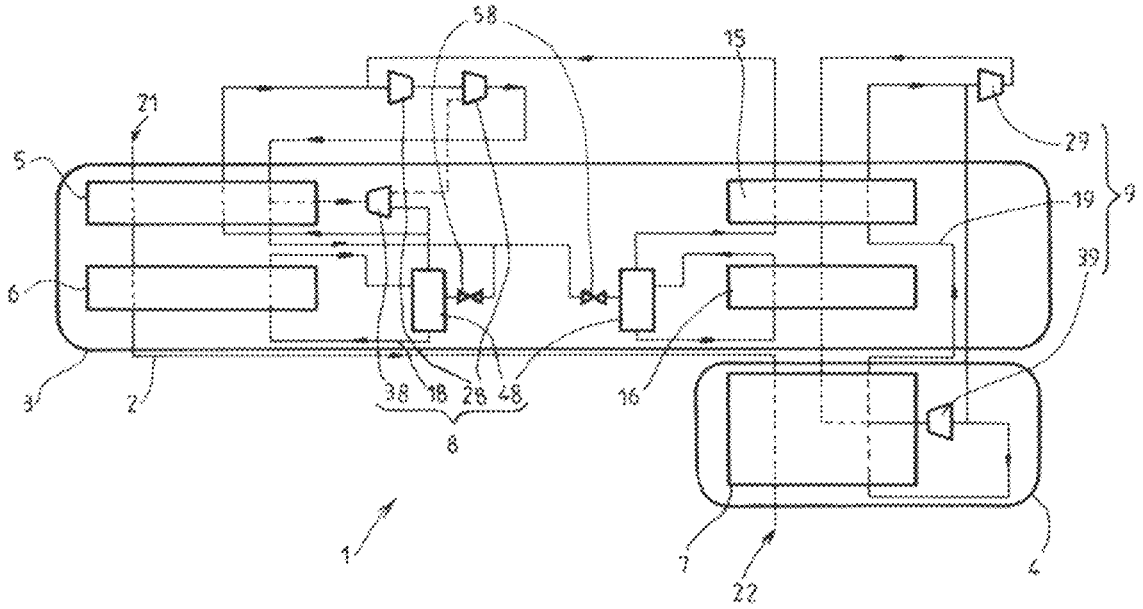

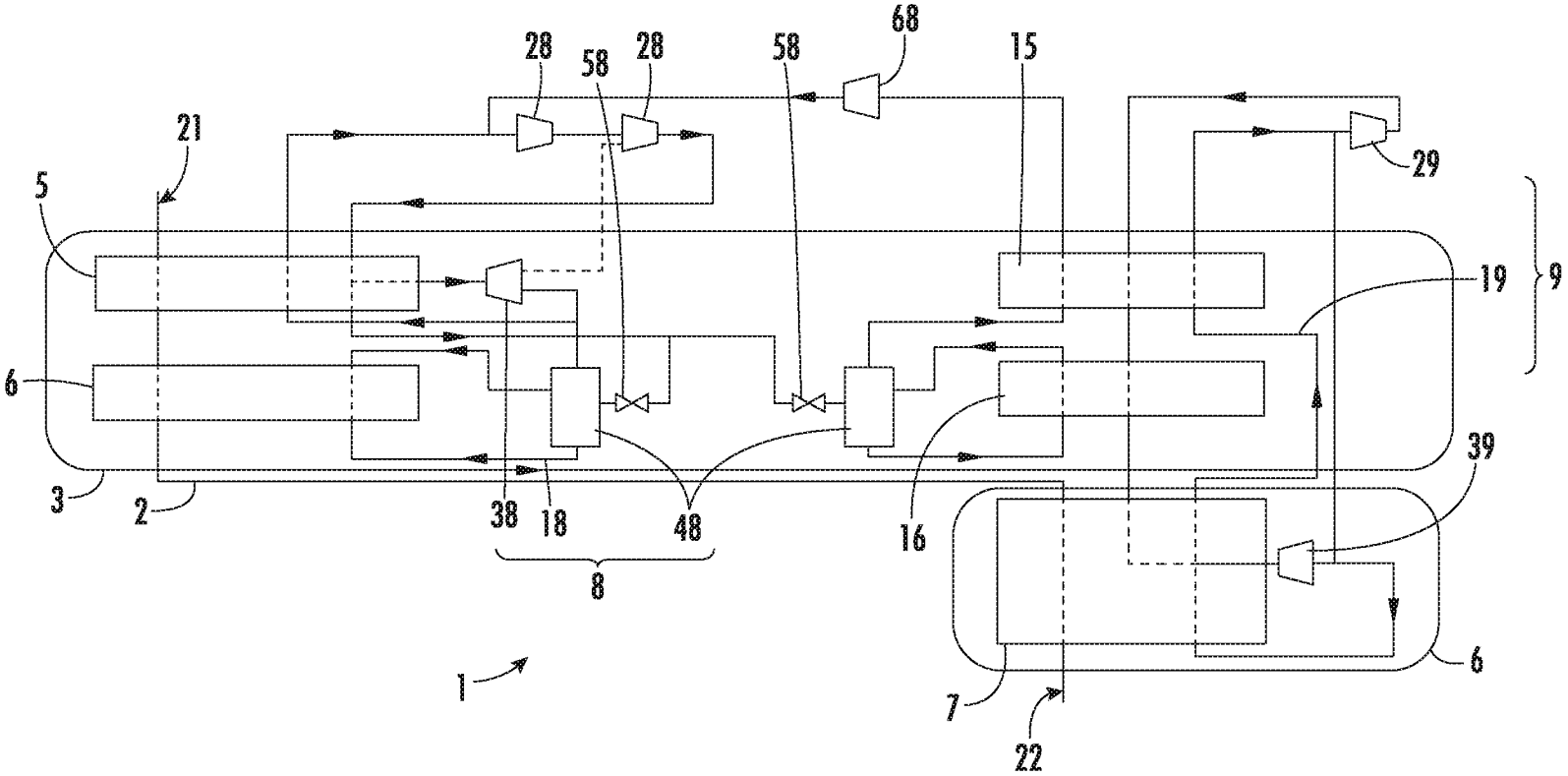
[FIG. 2]

INSTALLATION AND PROCESS FOR PRODUCTION OF A CRYOGENIC FLUID

CROSS REFERENCE TO RELATED APPLICATIONS

This application claims the benefit of priority under 35 U.S.C. § 119 (a) and (b) to French patent application No. FR2209712, filed Sep. 26, 2022, which is herein incorporated by reference in its entirety.

FIELD OF THE INVENTION

The invention relates to an installation and a process for production of a cryogenic fluid.

BACKGROUND OF THE INVENTION

The processes for liquefaction of hydrogen are divided into two successive parts: 1) the pre-cooling and 2) the cooling which assures the liquefaction. The pre-cooling can be carried out with a pre-cooling device which uses for example a nitrogen cycle (or another pre-cooling fluid) in a cold box. The optimisation of the nitrogen cycle is a compromise between the compactness of the cold box and the performance (power consumed).

The pre-cooling is generally carried out via a pre-cooling device using a closed pre-cooling fluid loop which produces cold via an appropriate thermodynamic cycle. The cold is produced for example by turbines for expansion of the flow of pre-cooling fluid. The hydrogen to be cooled is sub-cooled in the final pre-cooling exchanger, the temperature of which at the cold end is controlled efficiently thanks to a thermosiphon for the pre-cooling fluid. The fluid of the liquefaction cycle which assures the liquefaction is also pre-cooled in the main exchanger of the pre-cooling unit.

This known solution makes it necessary to provide large-sized heat exchangers in the pre-cooling cold box. The corresponding cold box is voluminous. Furthermore, the energy efficiency is not optimal.

SUMMARY OF THE INVENTION

An objective of the present invention is to eliminate some or all of the above-described disadvantages of the prior art.

For this purpose, the installation according to the invention, which moreover is in conformity with the generic definition given by the above preamble, is substantially characterised in that the cycle gas cooling unit and/or the cycle gas heating circuit comprise(s) one or a plurality of first cycle heat exchangers distinct from the first part of the pre-cooling heat exchangers of the circuit for the gas to be cooled, these first cycle heat exchangers also being cooled by thermal exchange with the pre-cooling fluid circuit of the pre-cooling device.

In one embodiment, the invention relates to an installation for production of a cryogenic fluid, in particular liquefied hydrogen, comprising a circuit for gas to be cooled having an upstream end which is designed to be connected to a source of gas, and a downstream end which is designed to be connected to at least one receiver system, for example a cryogenic storage unit, the installation comprising, positioned in at least one cold box, a set of heat exchangers in thermal exchange with the circuit for hydrogen to be cooled, the installation comprising a device for pre-cooling in thermal exchange with at least one first part of the set of heat exchangers, which device is configured to pre-cool the circuit for gas to be cooled to a first determined temperature, the installation also comprising a device for cryogenic cooling in thermal exchange with at least one second part of the set of heat exchangers, which device is configured to cool the circuit for gas to be cooled to a second determined temperature, lower than the first temperature, the pre-cooling device comprising a pre-cooling fluid closed-circuit refrigerator, the circuit comprising a device for compression of the pre-cooling fluid, a device for expansion of the pre-cooling fluid, at least one thermosiphon for the pre-cooling fluid, the said circuit comprising one or more portions in thermal exchange with at least one out of the first part of the set of heat exchangers, the cryogenic cooling device comprising a refrigerator with a cycle for refrigeration of a cycle gas in a work circuit, the cycle gas comprising at least one from out of: hydrogen, helium, neon, the work circuit of the refrigerator comprising a unit for compression of the cycle gas, a unit for cooling of the compressed cycle gas, a unit for expansion of the compressed and cooled cycle gas, and a unit for heating of the expanded cycle gas.

In addition, embodiments of the invention can comprise one or a plurality of the following characteristics:

- the first cycle heat exchanger(s) comprise(s) at least one heat exchanger in thermal exchange with a pre-cooling fluid flow of the circuit exiting from a thermosiphon; the first part of the set of heat exchangers for pre-cooling of the circuit for gas to be cooled, the first cycle heat exchanger(s), and at least part of the pre-cooling device, are positioned in a single first cold box;
- in the pre-cooling fluid circuit, the pre-cooling device comprises a set of compressors composing the device for compression of the pre-cooling fluid, a set of expansion turbines forming the pre-cooling fluid expansion device, and at least one thermosiphon for the pre-cooling fluid, comprising an input and an output connected to a loop of the pre-cooling fluid circuit in thermal exchange with at least one heat exchanger of the first part of the set of pre-cooling exchangers of the circuit for the gas to be cooled;
- the pre-cooling device comprises a thermosiphon for the pre-cooling fluid with an input and an output connected to a loop of the pre-cooling fluid circuit in thermal exchange with at least one first cycle heat exchanger;
- the thermosiphon comprising an input and an output connected to a loop of the pre-cooling fluid circuit in thermal exchange with at least one heat exchanger of the first part of the set of pre-cooling exchangers, and the pre-cooling fluid thermosiphon having an input and output connected to another loop of the pre-cooling fluid circuit in thermal exchange with at least one first cycle heat exchanger, are two distinct thermosiphons positioned in parallel in the pre-cooling fluid circuit;
- the at least one thermosiphon comprises at least one input and at least two outputs, the two outputs being connected to two distinct portions of the pre-cooling fluid circuit for in thermal exchange respectively with two distinct heat exchangers;
- the second part of the set of heat exchangers comprises at least one second cycle heat exchanger assuring thermal exchange between the circuit for hydrogen to be cooled and the work circuit of the cryogenic cooling device;
- the second cycle heat exchanger is in thermal exchange with a first portion of the work circuit of the device which conveys cycle gas before passage into an expansion unit, and with a second portion of the work circuit of the device conveying cycle gas after passage into the said expansion unit;

the second cycle heat exchanger is situated in a second cold box distinct from the first cold box;

the pre-cooling fluid comprises or is constituted by one from out of: nitrogen, or a mixture of the "MRC" type.

The invention also relates to a process for production of a cryogenic fluid, in particular liquefied hydrogen, using an installation according to any one of the characteristics described above or below, the process comprising a step of pre-cooling of the flow of the circuit for gas to be cooled to a first temperature of between 65 and 100 K, and preferably between 77 and 90 K, by means of the pre-cooling device, a step of pre-cooling of the cycle fluid via the pre-cooling device to a temperature of between 77 and 90 K, and a step of cooling of the gas circuit for gas to be cooled to a second determined temperature of between 18 and 25 K, and preferably between 20 and 23 K via the cryogenic cooling device.

According to other possible distinguishing features:

at least one cycle heat exchanger and/or at least one heat exchanger configured to pre-cool the circuit for gas to be cooled to a first determined temperature is in thermal exchange with a flow of pre-cooling fluid of the circuit exiting from a thermosiphon, the thermosiphon operating at a pressure of between 1.5 and 3.5 bars and at a corresponding temperature of between 80.8 K and 89.6 K.

The invention can also relate to any alternative device or process comprising any combination of the characteristics described above or below within the context of the claims.

Further particular features and advantages will become apparent upon reading the following description, which is provided with reference to the figures, in which:

BRIEF DESCRIPTION OF THE DRAWINGS

Other features and advantages of the invention will become further apparent via, on the one hand, the following description and, on the other hand, several exemplary embodiments given by way of non-limiting indication and with reference to the attached schematic drawings, in which:

FIG. 1 is a schematic partial view illustrating an example of a structure and the operation of a first example of an installation.

FIG. 2 is a schematic partial view illustrating an example of a structure and the operation of a second example of an installation.

DETAILED DESCRIPTION OF THE INVENTION

Throughout the figures, the same references relate to the same elements.

In this detailed description, the following embodiments are examples. Although the description refers to one or a plurality of embodiments, this does not mean that the characteristics apply only to a single embodiment. Simple characteristics of different embodiments can also be combined and/or interchanged in order to provide other embodiments within the context of the claims.

The installation 1 for production of a cryogenic fluid illustrated schematically in FIG. 1 comprises a circuit 2 for gas to be cooled/liquefied, in particular hydrogen. This circuit 2 for gas to be cooled has the upstream end 21 which is designed to be connected to a source of gas, and a downstream end 22 which is designed to be connected to at least one receiver system, for example a liquefied gas cryogenic storage unit.

Positioned in at least one cold box 3, 4, the installation 1 comprises a set of heat exchangers 5, 6, 7, in thermal exchange with the circuit 2 for hydrogen to be cooled.

The installation 1 comprises a pre-cooling device 8 in thermal exchange with at least one first part 5, 6 of the set of heat exchangers (or exchangers 5, 6 for pre-cooling of the circuit 2 for gas to be cooled). The pre-cooling device 8 is configured to cool the circuit 2 for gas to be cooled to a first determined temperature, for example between 65 and 100 K, and preferably between 77 and 90 K.

The installation 1 also comprises a device 9 for cryogenic cooling in thermal exchange with at least one second part 7 of the set of heat exchangers (further downstream). The cooling device 9 is configured to cool the circuit 2 for gas to be cooled from the first temperature to a second determined temperature lower than the first temperature, for example between 18 and 25 K, and preferably between 20 and 23 K.

As illustrated, this second part 7 of the set of heat exchangers comprises at least one second cycle heat exchanger 7 assuring thermal exchange between the circuit 2 for hydrogen to be cooled and the work circuit 19 of a cryogenic cooling device 9 described hereinafter.

The pre-cooling device 8 comprises a closed-circuit refrigerator 18 for pre-cooling fluid, for example nitrogen, or a mixture of refrigerant fluids (MRC) composed of the components proposed for example in the doctoral thesis by Songwut Krasae-in "Efficient Hydrogen Liquefaction Processes" ISBN978-82-471-1869-6. r, pages 43 and 44). Positioned in series and/or in parallel, the circuit 18 comprises a device 28 for compression of the pre-cooling fluid (one or a plurality of compressors in series and/or in parallel), a device 38 for expansion of the pre-cooling fluid (one or a plurality of turbines or valves in series and/or in parallel), and at least one thermosiphon 48 for the pre-cooling fluid.

The circuit 18 comprises one or a plurality of portions for thermal exchange with at least one heat exchanger of the first part 5, 6 of the set of heat exchangers.

Thus, the pre-cooling fluid is subjected to a cycle of compression-cooling-expansion-heating in the circuit 18, which produces cold power at one end at least of the circuit which is put into thermal exchange with the circuit 2 for gas to be cooled.

In particular, the circuit 2 for gas to be cooled is pre-cooled in at least one final exchanger 6 (the final one going from upstream to downstream), the temperature of which at the cold end can be controlled efficiently thanks to a flow of pre-cooling fluid generated by a thermosiphon 48.

The thermosiphon 48 is a system for circulation of the fluids (gas and/or liquid) based on expansion-contraction and buoyancy, the circulation being assured by differences of temperature between the different flows of fluid entering/exiting.

The thermosiphon 48 comprises for example at least one input and one output connected to a loop of the pre-cooling fluid circuit 18 in thermal exchange with at least one pre-cooling heat exchanger 6 of the circuit 2 for gas to be cooled. The thermosiphon 48 comprises for example a lower fluid input, an inner chamber for heating of the fluid, a vertical duct (vent) which is positioned at the top of this chamber, and a fluid output which is vertical relative to the axis of the input.

The cryogenic cooling device 9 for its part comprises a refrigeration cycle refrigerator for a cycle gas in a work circuit 19. The cycle gas preferably comprises at least one from out of: hydrogen, helium, neon.

The work circuit 19 of the refrigerator 9 is preferably closed, and comprises a unit 29 for compression of the cycle gas (one or a plurality of compressors in series and/or in parallel), a unit 15, 16, 7 for cooling of the compressed cycle gas (one or a plurality of heat exchangers), a unit 39 for expansion of the compressed and cooled cycle gas (one or a plurality of turbines or valves in series and/or in parallel), and a unit 7, 15 for heating of the expanded cycle gas (one or a plurality of compressors in series and/or in parallel).

Thus, the work fluid is subjected to a cycle of compression-cooling-expansion-heating which produces cold power at one end at least of the circuit 19, which is put into thermal exchange with the circuit 2 for gas to be cooled for the purpose of liquefying it.

As illustrated, the unit 15, 16, 7 for cooling of the cycle gas and the unit 7, 15 for heating of the cycle gas can comprise one or a plurality of heat exchangers, preferably counter-current, and assuring a thermal exchange between relatively cold and hot flows (in order to assure their heating and cooling respectively).

In particular, for the pre-cooling of the cycle gas and/or the heating of the cycle gas, the refrigerator 9 comprises one or a plurality of first cycle heat exchangers 15, 16, which are distinct from the first part of the heat exchangers 5, 6 configured to pre-cool the circuit 2 for gas to be cooled.

In addition, these first cycle heat exchangers 15, 16 are cooled by thermal exchange with the circuit 18 of the pre-cooling fluid of the pre-cooling device 8.

In other words, the pre-cooling of the circuit 2 for gas to be cooled (for example hydrogen) and the pre-cooling of the cycle gas (for example based on helium) are carried out by the pre-cooling fluid circuit (for example based on nitrogen) in separate distinct exchangers.

In other words, the work fluid of the refrigerator cycle 9 is pre-cooled in at least one first dedicated cycle heat exchanger 15, 16, which does not exchange with the circuit 2 of fluid to be cooled.

In addition, this cycle gas can be pre-cooled in a heat exchanger 16, the temperature of which at the cold end can be controlled efficiently by a flow of pre-cooling fluid generated by a thermosiphon 48 (preferably a thermosiphon 48 which is distinct from the thermosiphon 48 previously described, which assures the pre-cooling of the gas circuit 2).

Thus, and as represented, the thermosiphon 48 associated with a first cycle heat exchanger 15, 16 and the thermosiphon 48 associated with at least one pre-cooling exchanger of the circuit 2 for gas to be cooled can be distinct, and for example positioned in parallel and/or in series in the pre-cooling fluid circuit 18.

Thus, the pre-cooling of the cycle gas of the refrigerator 9 by the pre-cooling fluid in a dedicated heat exchanger (distinct from the pre-cooling of the circuit 2 to be cooled) makes it possible to maximise the pre-cooling of the circuit 2 for hydrogen to be cooled and the pre-cooling of the cycle gas of the refrigerator 9.

As illustrated, after its expansion and its thermal exchange with the circuit 2 of gas to be cooled, the cycle gas of the refrigerator 9 can, by returning towards the compression unit 29, yield kilogramme calories to the pre-cooling fluid in a heat exchanger 15 (before return to the compression unit 28).

As illustrated, the thermosiphon(s) 48 can comprise at least one input and at least two outputs, the two outputs being connected to two distinct portions of the pre-cooling fluid circuit 18 in thermal exchange with the heat exchanger(s) 5, 6, 15, 16 concerned.

The thermosiphon 48 for the pre-cooling fluid has for example at least one input and one output connected to a loop of the pre-cooling fluid circuit 18 in thermal exchange with at least one first cycle heat exchanger 15, 16.

In other words, the first heat exchanger(s) 15, 16 comprise(s) at least one heat exchanger in thermal exchange with a flow of pre-cooling fluid of the circuit 18 exiting from a thermosiphon 48.

The thermosiphon 48 connected to at least one exchanger 16 makes it possible to control efficiently the temperature of the cycle fluid of the refrigerator 9.

The pre-cooling liquid is produced by the pre-cooling device 8. The liquid pre-cooling fluid can be expanded in a turbine 38 or a valve before being sent to the thermosiphon(s) 48. In the case when the installation comprises a plurality of thermosiphons 48, the pressures within the thermosiphons 48 can be different. The low-pressure pre-cooling fluid produced by the thermosiphon(s) 48 and by the expansion device 38 can be put into thermal exchange with some or all of the heat exchangers (pre-cooling heat exchangers 5, 6 of the circuit 2 on the one hand, and the heat exchangers 15, 16 of the refrigerator circuit 9 on the other hand). This flow or these flows of relatively cold cooling fluid yield(s) kilogramme calories respectively to the exchangers concerned, in order to cool the gas 2 to be cooled and the cycle gas. The cooling fluid thus heated is sent to the input of the same compressor(s) 28 of the pre-cooling device 8, and a new cycle can begin.

This configuration with dissociated exchangers respectively for the pre-cooling of the circuit 2 for gas to be cooled and for the pre-cooling of the circuit 19 for the work gas (with respective dissociated pre-cooling flows) makes it possible to use in a cold box 3 exchangers with a size which is relatively smaller than in the prior art. In addition, this separate distribution of cold power of the device 8 for pre-cooling of the circuit 2 for gas to be cooled and for the cycle fluid of the refrigerator 9 increases the global efficiency of the installation.

The use of a thermosiphon 48 for the pre-cooling of the cycle gas of the refrigerator 9 makes it possible to pre-cool the cycle gas of the refrigerator 9 to a lower temperature. This makes it possible to decrease the energy consumption for the liquefaction of the gas to be cooled of the circuit 2 in the cold box 4. The temperature can be lower, since the temperature of the liquid pre-cooling fluid is controlled by the pressure within the thermosiphon(s) 48. In addition, the thermal exchange can be greater in the dedicated exchangers 6, 16.

As illustrated, the heat exchanger(s) 5, 6 configured for pre-cooling of the circuit 2 for gas to be cooled, the first cycle heat exchanger(s) 15, 16, and at least part 38, 48 of the pre-cooling device 8 (cold elements: turbine(s), thermosiphon(s), cold ducts, cold valve(s), etc.) are positioned in a single first pre-cooling cold box 3.

This first cold box 3 is preferably thermally insulated under vacuum, or thermally insulated by means of perlite (or another insulator) and swept with a gas such as nitrogen for example.

The second cycle heat exchanger(s) 7 which is/are provided in order to liquefy the gas of the circuit 2 for gas to be cooled is/are preferably situated in a second cold box 4 distinct from the first cold box 3 (thermally insulated under vacuum or by another means). This second cold box 4 also preferably contains the associated cryogenic components (turbine, valve(s), etc.).

As illustrated, the final second cycle heat exchanger 7 can be in thermal exchange with a first portion of the work circuit 19 of the device 9 which conveys cycle gas before passage into an expansion unit 39 (turbine(s) 39), and with a second portion of the work circuit 19 of the device 9 which conveys cycle gas after passage into the said expansion unit 39. In other words, the cycle exchanger 7 can comprise multiple passages of the work circuit 19 of the refrigerator 9.

The arrangement with the two thermosiphons 48 in parallel can make it possible to operate these two thermosiphons at different pressures, so that the loss of load in the pre-cooling cycle (as far as the input of the compressor 28) is identical in both branches of the circuit (on the side of the pre-cooling circuit in thermal exchange 5, 6 with the circuit 2 for gas to be cooled, and on the side of the heat exchange 15, 16 with the liquefaction cycle of the first cycle exchangers).

In addition, according to this arrangement, it is possible to decrease the pressure on the side of the thermosiphon 48 in thermal exchange with the first cycle exchangers 15, 16 of the refrigerator. This makes it possible to pre-cool the cycle gas relatively slightly more. This makes it possible to improve the performance and global control of the installation.

The pre-cooling fluid circuit 18 preferably comprises a set of valves making it possible to control the operative pressures of the two thermosiphons 48 in parallel. For example, two valves 58 control respectively the input of fluid into the thermosiphons 48, for example valves of the Joule Thomson type.

As a variant or in combination, a valve/valves can be provided in the pre-cooling fluid circuit 18 upstream from the compressor(s) 28, in order to regulate the pressure at the input of the compression device (so as to ensure that the flows of the two loops of the circuit return to the same pressure at the input of the common compressor 28).

As a variant or in combination, the second thermosiphon 48 (associated with the first exchanger 15 of the refrigerator 9) can be connected to a sub-atmospheric compressor which is configured to decrease the pressure within it further still.

FIG. 2 discloses this variant with a sub-atmospheric compressor 68 on the conduit linking the second thermosiphon 48 to the inlet of the compression organ 28.

As illustrated in broken lines, a compressor 28 can be coupled to a turbine 38 (turbocompressor).

As a variant or in combination, (not illustrated), the flow feeding the second thermosiphon 48 (associated with the heat exchanger(s) of cycle 16) may be pre-cooled by first thermosiphon 48 (associated with precooling heat exchangers). That is to say, the conduit feeding the second thermosiphon 48 is before in heat exchange with at least one precooling heat exchanger. In this configuration, the distribution of cold between the two cycles can be changed. The first thermosiphon 48 (linked to the precooling) will treat for example more fluid flow and more precooling power available.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

What is claimed is:

1. An installation for production of a cryogenic fluid, wherein the cryogenic fluid comprises liquefied hydrogen, the installation comprising:

a hydrogen circuit configured to cool hydrogen gas having an upstream end that is configured to connect to a source of hydrogen gas, and a downstream end which is configured to connect to at least one receiver system;

a set of heat exchangers positioned, in at least one cold box, in thermal exchange with the hydrogen circuit;

a pre-cooling device configured to pre-cool the hydrogen circuit to a first determined temperature, wherein the pre-cooling device is in thermal exchange with a first part of the set of heat exchangers; and a cryogenic cooling device in thermal exchange with a second part of the set of heat exchangers, wherein the cryogenic cooling device is configured to cool the hydrogen circuit to a second determined temperature that is lower than the first temperature, wherein the pre-cooling device comprises a pre-cooling fluid closed-circuit refrigerator, wherein the pre-cooling fluid closed-circuit refrigerator further comprises:

a device compressor configured to compress the pre-cooling fluid, an expansion turbine configured to expand the pre-cooling fluid, wherein said pre-cooling fluid closed-circuit refrigerator further comprises one or a plurality of passages configured for thermal exchange with at least one heat exchanger of the first part of the set of heat exchangers, wherein the cryogenic cooling device comprises a refrigerator with a cycle for refrigeration of a cycle gas in a work circuit, the cycle gas comprising at least one from out of: hydrogen, helium, and neon, wherein the work circuit of the refrigerator comprises:

a cycle gas compressor configured to compress the cycle gas, a cooling heat exchanger configured to cool the compressed cycle gas, an cycle gas expansion turbine configured to expand the compressed and cooled cycle gas, and a heating heat exchanger configured to heat the expanded cycle gas, wherein the cooling heat exchanger and/or the heating heat exchanger comprise(s) at least one first cycle heat exchangers distinct from the first part of the pre-cooling heat exchangers of the circuit, wherein the first cycle heat exchangers are configured to be cooled by thermal exchange with the pre-cooling fluid circuit of the pre-cooling device, wherein the pre-cooling device further comprises:

a first thermosiphon having a first input and a first output connected to a first loop of the pre-cooling fluid circuit, the first loop being in thermal exchange with at least one heat exchanger of the first part of the set of heat exchangers; and a second thermosiphon, distinct from the first thermosiphon, having a second input and a second output connected to a second loop of the pre-cooling fluid circuit, the second loop being in thermal exchange with the at least one first cycle heat exchanger, wherein the first thermosiphon and the second thermosiphon are positioned in parallel within the pre-cooling fluid circuit.

2. The installation according to claim 1, wherein the first part of the set of heat exchangers for pre-cooling of the hydrogen circuit, the first cycle heat exchanger(s), and at least part of the pre-cooling device, are positioned in a single first cold box.

3. The installation according to claim 1, wherein the first and/or second thermosiphon comprises at least one input and at least two outputs, the two outputs being connected to two distinct portions of the pre-cooling fluid circuit for heat exchange respectively with two distinct heat exchangers.

4. The installation according to claim 1, wherein the second part of the set of heat exchangers comprises at least one second cycle heat exchanger assuring thermal exchange between the hydrogen circuit and the work circuit of the cryogenic cooling device.

5. The installation according to claim 4, wherein the second cycle heat exchanger is in thermal exchange with a first portion of the work circuit of the device which conveys cycle gas before passage into the cycle gas expansion turbine, and with a second portion of the work circuit of the device conveying cycle gas after passage into the cycle gas expansion turbine.

6. The installation according to claim 4, wherein the second cycle heat exchanger is situated in a second cold box distinct from the first cold box.

7. The installation according to claim 1, wherein the device compressor and/or a set of valves of the pre-cooling fluid circuit are configured to control the operative pressures of the first thermosiphon and the second thermosiphon in parallel at different pressures.

8. The installation according to claim 1, wherein the pre-cooling fluid comprises or is constituted by one from out of: nitrogen, or a mixture of an MRC type.

9. A process for production of a cryogenic fluid comprising liquefied hydrogen, the process comprising the steps of:

providing the installation according to claim 1;

pre-cooling of the flow of the hydrogen circuit to a first temperature of between 65 and 100 K by means of the pre-cooling device;

pre-cooling of the cycle gas via the pre-cooling device to a temperature of between 77 and 90 K; and cooling of the hydrogen circuit to a second determined temperature of between 18 and 25 K via the cryogenic cooling device.

10. A process according to claim 9, wherein at least one cycle heat exchanger and/or at least one heat exchanger configured to pre-cool the hydrogen circuit to a first determined temperature is in thermal exchange with a flow of pre-cooling fluid exiting from the first thermosiphon or the second thermosiphon, the respective thermosiphon operating at a pressure of between 1.5 and 3.5 bars and at a corresponding temperature of between 80.8 K and 89.6 K.

11. The process according to claim 9, wherein the first temperature is between 77 K and 90 K.

12. The process according to claim 9, wherein the second determined temperature is between 20 K and 23 K.

* * * * *